United States Patent [19]

El-Ramey

[11] 4,417,538

[45] Nov. 29, 1983

[54] MARINE ANCHOR WITH RELEASE CAPABILITY

[76] Inventor: Thomas A. El-Ramey, Rte. 2, Box 813, Pompano Beach, Fla. 33067

[21] Appl. No.: 296,959

[22] Filed: Aug. 27, 1981

[51] Int. Cl.[3] ..... B63B 21/44

[52] U.S. Cl. ..... 114/298; 114/297; 114/304; 114/310

[58] Field of Search ..... 114/298, 299, 294, 297, 114/304, 310

[56] References Cited

U.S. PATENT DOCUMENTS

| | | | |
|---|---|---|---|
| 411,948 | 10/1889 | Wixon . | |
| 543,129 | 7/1895 | Dunn | 114/304 |
| 665,500 | 1/1901 | Baldt | 114/304 |
| 677,619 | 7/1901 | Baldt | 114/304 |
| 2,674,970 | 4/1954 | Andrews . | |
| 2,940,411 | 6/1960 | Bartels . | |
| 2,982,244 | 5/1961 | Triechman . | |
| 3,021,812 | 2/1962 | Swails . | |
| 3,059,607 | 10/1962 | Wheeler . | |
| 3,123,037 | 3/1964 | Jensen . | |
| 3,138,134 | 6/1964 | Botine . | |
| 3,397,665 | 8/1968 | Lindly . | |
| 3,450,008 | 6/1969 | Guier . | |
| 3,913,514 | 10/1975 | Reynolds | 114/297 |
| 4,067,287 | 1/1978 | Sabella . | |
| 4,114,554 | 9/1978 | Miller | 114/298 |
| 4,134,355 | 1/1979 | Carruthers | 114/297 |

*Primary Examiner*—Trygve M. Blix
*Assistant Examiner*—C. T. Bartz

[57] ABSTRACT

An anchor having release capabilities includes a pair of generally planar and spaced-apart flukes joined to a cylindrical tube. A shaft is located intermediate the flukes, the tube passing through the shaft to provide 360° movement between the flukes and shaft. The shaft includes spaced-apart and parallel plates adjacent the tube. A rod is disposed within the tube and a perpendicular trigger is attached thereto, the trigger extending through an opening in the tube. The rod is retained between the plates of the shaft by a replaceable, breakable tie. A locking ring element may be used with the anchor to prevent the release capability. The ring is slidable over the plate portion of the shaft to maintain the rod therebetween. A float may be employed with an anchor to prevent entanglement with obstructions such as the superstructures of submerged vessel. The float is coupled to the anchor shaft by a length of rope, cable, or chain so that the float remains below the water surface.

8 Claims, 4 Drawing Figures

MARINE ANCHOR WITH RELEASE CAPABILITY

BACKGROUND OF THE INVENTION

1. Field of the Invention

This invention relates generally to boat anchors and more particularly to boat anchors which include a feature to permit the anchor to be released from underwater entanglements in the event normal anchor retrieval is not possible.

2. Description of the Prior Art

It has been known for many years that boat anchors can become entangled in underwater obstructions such as rocks, coral reefs, etc. Retrievel of the anchor once it has become entangled is time consuming and there is a substantial probability that the anchor may be lost. It is also known in the prior art that anchors can be designed with a release feature which can be operated at the discretion of the boat operator. If the owner determines that retrieval in the normal manner is not possible, the operator uses the release feature to disengage the flukes from whatever obstruction is encountered. It is also known in the prior art that anchor chains can become entangled in underwater obstructions and it has been suggested that a float on the water surface be provided to keep the chain in a vertical position. A brief summary of pertinent prior art patents illustrating the foregoing will now be provided.

Wixon, in his 1889 U.S. Pat. No. 411,948 entitled "Anchor", describes a device having a pair of sharp, pointed flukes pivoted to an anchor shaft. Each fluke includes a spur portion which is generally parallel to the shaft when the anchor is in its functional position. A ring is slidedly disposed over the shaft and is designed to encircle the spurs to retain the anchor in its normal position. A separate rope is attached to the ring and if the boat owner desires to release the anchor, he pulls the ring upwardly to release the spurs and allow the flukes to drop to a position in which they point downwardly from the shaft.

In Andrews' U.S. Pat. No. 2,674,970 issued Apr. 13, 1954 and entitled "Boat Anchor", the anchor includes three flukes having heart-shaped end points, the flukes being pivotally coupled to the shaft by thin rods. The inner ends of the flukes are recessed into the shaft and a spring-loaded collar slips over the inner ends when the anchor is in its functioning position. By pulling a separate rope, the operator can retract the collar against the spring pressure, allowing the flukes to drop downwardly into a retrieval position.

Bartels, et al. describe a "Collapsible Boat Anchor" in their U.S. Pat. No. 2,940,411 issued June 14, 1960. The anchor includes four thin, ski-shaped flukes pivoted to a bottom plate. Each fluke is also coupled to the shaft by a tie rod. A first end of the tie rod is pivoted to the fluke outwardly from the shaft and the other end of the tie rod is slidably coupled to the shaft through a slot. A ring is coupled to the bottom of the anchor and the anchor rope is attached to this ring. A snatch clip is positioned high on the shaft and the rope passes through the snatch clip before rising to the surface. When underwater obstructions are encountered, the operator jerks the rope to release it from the snatch clip and the anchor is raised from the bottom allowing the flukes to drop downwardly into a retrieval position.

Another prior art device is described in Triechman's U.S. Pat. No. 2,982,244 issued May 2, 1961 for "Collapsible Boat Anchor." This anchor includes four pointed, elongate flukes, each with a notch on the pivoted end. The flukes are held in the functioning position when a locking ring engages the notches. A sliding collar weight is provided to lower the locking ring and allows the flukes to drop into a retrieval position.

Swails, in U.S. Pat. No. 3,021,812 issued Feb. 20, 1962 for "Releasable Anchor" describes a system similar to that of the aforementioned Andrews patent, but this device includes a spring-loaded pin trigger mechanism for releasing the locking collar. The collar is biased toward the release position. Once the pin is released, the flukes drop downwardly for retrieval.

Wheeler, in U.S. Pat No. 3,059,607 issued Oct. 23, 1962 for "Anchor" describes a device which includes elongate, pointed flukes pivotally coupled to a shaft at one end with tie rods slidably coupled to the shaft and movable downwardly thereon to permit the flukes to drop to a retrieval position.

A different arrangement is depicted in Jensen's U.S. Pat. No. 3,123,037 issued Mar. 3, 1964 for "Boat Anchor." In this device, the spring-loading is accomplished below the flukes on an extension of the shaft and the spring urges the flukes to a downward retrieval position. The flukes are pivotally coupled to a first collar. A second collar is secured to the upper end of the shaft and a tie rod is coupled between each fluke and the second collar. A release pin mechanism and second rope are provided for disengaging the pin and placing the anchor in the retrieval position.

Botine's June 23, 1964 U.S. Pat. No. 3,138,134 for a "Boat Anchor" describes another spring-loaded system which includes a plunger and a spring. The bottom of the plunger engages the inner ends of the elongate flukes until sufficient pressure is applied against the spring to cause the anchor to assume its retrieval position.

In U.S. Pat. No. 3,397,665 issued Aug. 20, 1968 for "Boat Anchor", Lindly describes another system employing pivotable flukes and a sliding casing which locks the flukes in the anchoring position. The anchor rope is attached to the casing while a weaker section of the rope is attached to the anchor body. If normal tension is applied to the weaker section, it will hold and the anchor can be raised. If the anchor becomes entangled, greater tension will brake the weak section of the rope allowing the casing to release so the anchor assumes its retrieval position.

Guier, in U.S. Pat. No. 3,450,008 issued June 17, 1969 for "Anchor Having Pivotable Flukes", describes an anchor having a fluke portion formed from pre-cut plates which have holes in them. Rods pass through the holes and are journaled to retain the plates in assembly. A float is also provided which has fins on it. The fins rotate when the anchor is being lowered to act as a drag on anchor descent.

An "Anchor Float Adapter" is described by Sabella in his Jan. 10, 1978 U.S. Pat. No. 4,067,287. The adapter includes a tubular body suspended from a float, the body having quick connect and disconnect features.

All of the aforementioned devices suffer from one or more disadvantages. Many of the devices are unsuitable for use in salt water because of the corrosive effect on parts such as springs, release pins, and the like. Other devices are cumbersome and require time consuming manipulation of two ropes. In addition, most of the devices which employ a quick release feature have sharp, elongate flukes which are not effective when anchoring in sand. An anchor system which overcomes the above-noted disadvantages would be a significant advance in the anchor art.

SUMMARY AND OBJECTS OF THE INVENTION

It is a primary object of the present invention to provide an anchor having release capabilities and which overcomes the above-noted disadvantages of the prior art.

Another object of the present invention is to provide an anchor system which may be used in salt water.

Yet another object of the present invention is to provide an anchor which has flukes which are effective for anchoring in sand and which offer desirable planing characteristics to make retrieval of the anchor easier than with conventional anchors.

A further object of the present invention is to provide an anchor which has a release feature and which may be readily modified to provide for different pull tensions before the release feature is triggered.

A different object of the present invention is to provide an anchor having release features and which includes a selective system for preventing the release feature at the descretion of the boat operator.

Another object of the present invention is to provide a float system for use with boat anchors to effectively prevent the anchor chain or cable from being ensnarled in underwater obstructions.

Still another object of the present invention is to provide an anchor which has a flat profile for storage.

How and these other objects of the present invention are accomplished will be described in the following specification, taken in conjunction with the drawings. Generally, however, the objects are accomplished by providing an anchor having a pair of flat flukes joined to a cylindrical tube. The flukes are spaced apart by a distance which permits the anchor shaft to be rotatably coupled to the central portion of the tube. A rod element is also provided within the cylindrical tube and an elongate trigger extends through a hole in the tube. A tie strap is provided to confine the trigger and shaft, and the system permits a limited arc of movement and allows the flukes to assume an anchoring position on either side of the shaft. The tie is selected depending on the size and use of the anchor and will be broken when sufficient vertical pressure is exerted on the anchor line. Once the tie is broken, the anchor flukes pivot about the axis of the tube and drop to a retrieve position. After the anchor is retrieved, it can be made ready for reuse by applying a new tie. A slidable cup may be provided over the shaft to lock the rod and trigger and prevent the release feature. A final feature of the present invention is a float member fixed to the anchor chain, rope, or cable a fixed distance above the anchor. The float is generally below the water surface. The float maintains the line between the float and the anchor in a vertical and taught position and aids in preventing entanglement with underwater obstructions. The float feature is especially useful when it is desired to anchor in submerged vessels. It is rarely needed in natural terrain. Other features of the invention will become apparent to those skilled in the art after reading the following description of the preferred embodiment.

DESCRIPTION OF THE PREFERRED EMBODIMENT

Figure 1:
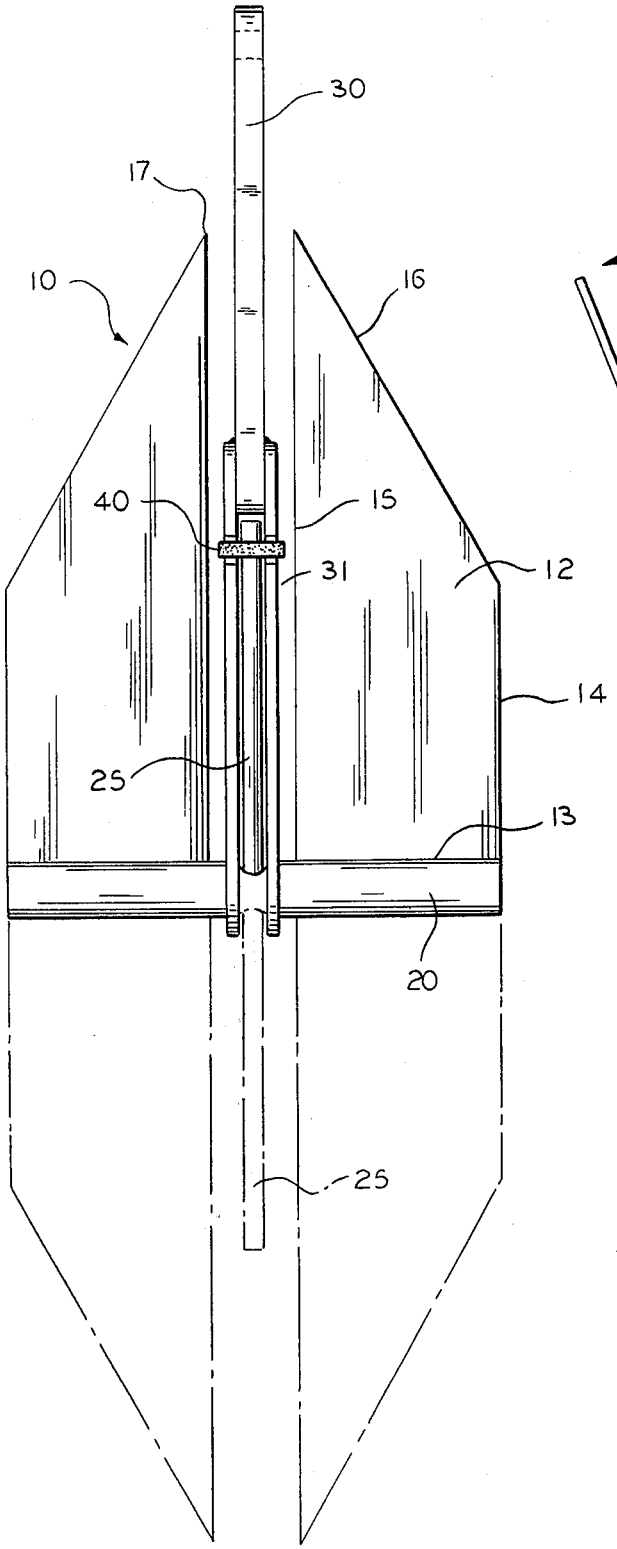
FIG. 1 is a front perspective view of an anchor according to the preferred embodiment of the present invention showing the anchor flukes in the storage position in full line and in the released retrieve position in broken line.
Figure 2:
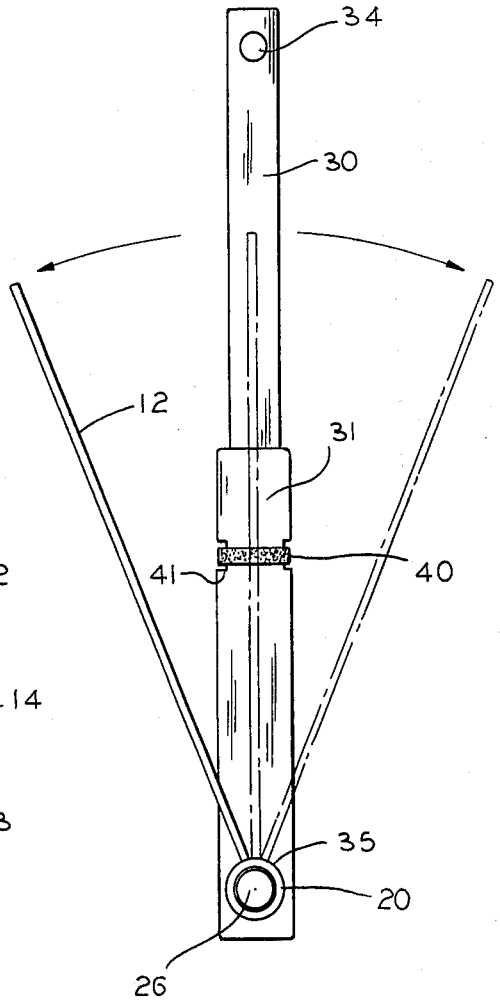
FIG. 2 is an end view of the anchor shown in FIG. 1 illustrating the flukes in one anchoring position in full line and in the stowage and alternate anchoring positions in broken line.
Figure 3:
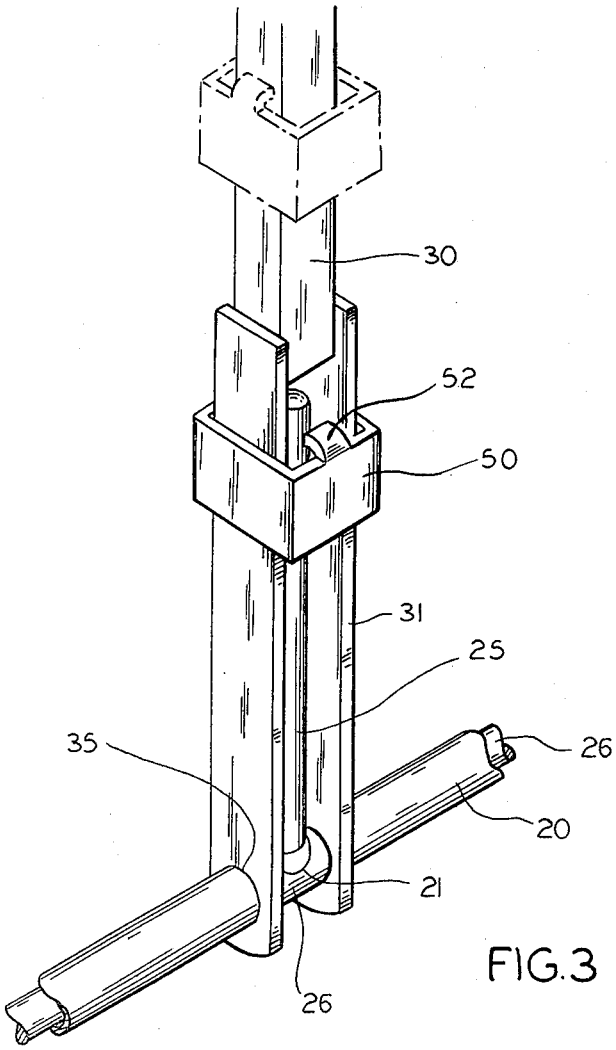
FIG. 3 is a perspective view of the anchor shown in FIG. 1, with the flukes removed, and showing the locking mechanism in its prevent position in full line and in its inactivated position in broken line; and, FIG. 4 is an illustrative diagram showing the float mechanism of the present invention.

An anchor 10 which fulfils the aforementioned objects of the invention is shown in FIGS. 1–3. Anchor 10 includes a pair of flukes 12 which are generally planar and relatively thin plates of galvanized steel, aluminum, stainless steel, or other suitable material. The particular contruction materials are not critical to the present invention.

Flukes 12 include a base edge 13 having parallel sides 14 and 15 extending perpendicular therefrom, edge 15 being longer than edge 14. Edge 16 connects the sides. A point 17 is formed at the intersection of edge 15 and connecting edge 16. The particular size and configuration shown is again for purposes of illustrative rather than limitation.

The base edges 13 of flukes 12 are welded or otherwise suitably attached to a hollow cylindrical tube 20, so that the flukes are generally coplanar and so that the edges 15 of the respective flukes are spaced apart from one another. Tube 20 is provided with a round or oblong opening 21 (See FIG. 3). The purpose of this opening will be apparent as the remaining components of anchor 10 are described.

The next component of anchor 10 is a release element which includes an elongate trigger 25 extending between the edges 15 of flukes 12 and through opening 21. Inside tube 20, the trigger 25 is joined (for example, by a screw connection) to a rod 26 disposed within tube 20 and having an axis coinciding therewith. Opening 21 has a diameter larger than the diameter of trigger 25 or is oblong and extends around the surface of tube 20. From this description, it will be apparent that trigger 25 has limited freedom of movement with respect to flukes 12, the degree of movement preferably being less than 90° about the axis of tube 20.

The anchor shaft of the preferred embodiment of the present invention comprises three major sections, a shank 30 and a pair of retainer plates 31. Shank 30 is preferably an elongate, solid metal bar having a hole 34 at one end to which the anchor rope, cable or chain will be attached. Plates 31 are welded to the end of shank 30 opposite from hole 34 in such a manner that the plates are parallel and spaced apart from one another.

A pair of aligned holes 35 are provided adjacent the free ends of plates 31, the holes having a diameter just slightly exceeding the diameter of tube 20. The holes are provided to couple the shaft to the tube between flukes 12. Of course, in constructing the anchor, the shaft will be separably constructed and will be inserted over tube 20 before the flukes are welded thereto.

From the description provided to this point, it should be apparent that 360° rotational movement is provided between the flukes 12 and the anchor shaft. Such movement is illustrated in FIG. 1 where the flukes are shown to be movable between a position in which the points 17 are directed upwardly, to the opposite extreme where they are directed downwardly.

To retain the flukes in an anchoring position according to the present invention, trigger 25 is retained between plates 31 by a breakable tie 40. The tie is held in notches 41 in each of plates 31 near the top thereof. With tie 40 in place, the flukes have a more limited freedom of movement between the extremes shown in FIG. 2. Note also in this FIGURE that for stowage, the various anchor elements are flat.

Tie 40 may be selected from a wide variety of materials and the choice will depend on the size of anchor 10 and the anticipated anchoring conditions. One preferred type of tie is the common electrical binder or conduit strap which is an elongate strip of plastic material having teeth like serrations along one side and a locking element with a flap on one end. When the other end of the tie is inserted into the locking element, a loop is formed, the diameter of which may be reduced as desired. The flap, however, by engaging the teeth will not permit the loop to be expanded. Such ties are well known and need not be described in further detail. These ties also come in a variety of sizes, each of which would have a different breaking strength. Another example of a suitable tie material would be wire wound around the notches, the number of loops of wire determining the strength of the tie. Other systems will become apparent to one skilled in the art after reading the present specification.

The operation of the anchor of the present invention can now be described. An anchor line is attached to shank 30 through hole 34 (or a swivel clip attached to the shank). When the anchor is lowered and reaches the bottom, it will assume one of the extended positions shown in FIG. 2 and bite into the bottom. In most cases, the anchor will be simply raised to the surface by pulling on the anchor line.

In those cases where the anchor becomes entangled on a rock or other obstruction, additional pulling force exerted vertically on the anchor line will cause trigger 25 to rupture the tie 40, allowing the anchor to assume the position shown in broken line in FIG. 1. It may then be retrieved. The anchor may be made ready for reuse simply by placing trigger 25 back between plates 31 and adding a new tie 40.

There may also be occasions when added anchoring strength is required, for example with heavier boats or when anchoring overnight or in heavy seas. On such occasions, an additional tie may be used or, if using the aforementioned electrical ties, the tie may be wrapped around the notches twice before locking.

There may also be occasions where it is desired to totally prevent the release capability of anchor 10. This may be accomplished in a variety of ways which will be apparent to one skilled in the art after reading this specification. However, the preferred method is to employ a locking ring 50 slidably disposed over the anchor shaft which may be constructed of metal or plastic. One preferred construction for ring 50 is shown in FIG. 3, the ring being generally rectangular in shape and having a pair of flanges 52 extending inwardly from the top of one pair of opposed sides. The flanges are arranged for contacting the ends of plates 31 when in a first orientation, the bottom edges of the walls of cup 50 being above the end of trigger 25 in this position. When it is desired to prohibit release, ring 50 is removed from the anchor 10 by sliding it over the upper end of shank 30, rotating ring 50 by 90° and sliding it back down over shank 30 and over plates 31. In this orientation, the flanges 51 slide between the edges of plates 31 and allow ring 50 to be located along the length of trigger 25. The release preventing mode may be employed with or without tie 40 being in position.

Other disengagement techniques may also be employed such as providing a cotter type pin and aligned holes in plates 31 and rod 25. The pin, when inserted through the three elements, would provide the same result as ring 50.

Figure 4:
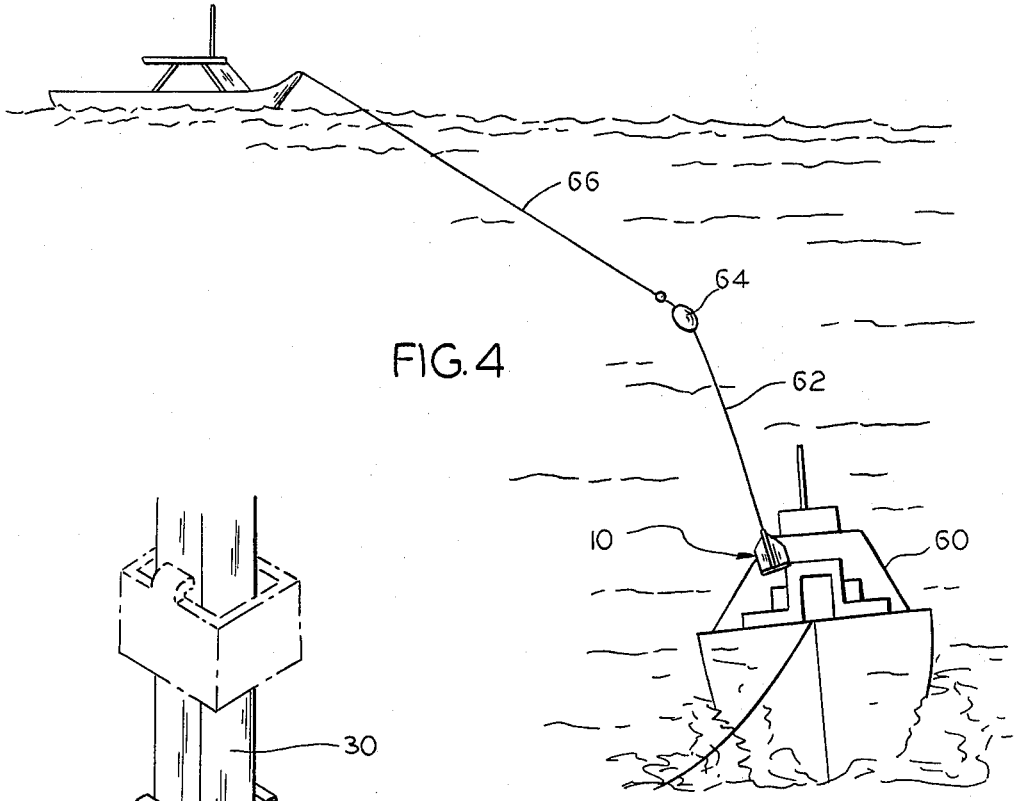

Proceeding now to a description of FIG. 4, an anchor 10 is attached to the superstructure of a submerged vessel 60. In lieu of the normal anchor line, a length of cable 52 is attached to the anchor 10 and to a float 54. Cable 52 may be any suitable length so long as the depth from the surface to the anchoring location exceeds the length of cable 52 and so long as cable 52 is of sufficient length to absorb any abrasion which may occur on the superstructure above anchor 10. Float 54 is then coupled to the boat with another length of anchor line which may be chain, rope, cable, etc., preferably floating nylon anchor line.

The floatation arrangement just described aids in preventing entanglement of cable 52 by maintaining it in a taut and vertical position. Slack which could wrap around underwater obstructions is eliminated. It should be appreciated that while the system just described has utility when boats are anchored in submerged vessels, its principles ar also applicable when anchoring in reefs, sunken trees, etc.

While the present invention has been described by reference to a preferred embodiment, the invention may be variously embodied. The invention is, therefore, not to be limited by the foregoing description, but it is to be limited solely by the claims which follow.

I claim:

1. An anchor comprising a cylindrical tube, a pair of generally flat fluke means having one edge coupled to said tube, said fluke means being spaced apart and lying generally in the same plane with one another, an anchor shaft rotatably coupled to said tube intermediate said fluke means, an opening in said tube intermediate said fluke means and a first rod means within said tube, elongate trigger means secured perpendicularly to said rod means and extending through said opening and means for releasably securing said trigger means to said anchor shaft, said securing means being breakable when the force applied to separate said trigger means and said shaft exceeds a preselected value, said opening permitting said fluke means to move in an arc defined by an acute angle around the axis of said tube when said securing means is in place.

2. The invention set forth in claim 1 wherein said trigger means comprises a second rod and said securing means comprises a strap means surrounding said trigger means and said shaft.

3. The invention set forth in claim 1 wherein said shaft comprises a first elongate bar means having a hole in one end for the attachment of an anchor line, second and third elongate and parallel bar means joined to opposite sides of the second end of said first bar, said second and third bars having aligned holes in the end thereof remote from said first bar, said holes being larger in diameter than said tube and serving as the means for rotatably coupling said shaft to said tube, and said opening being located intermediate said second and third bars.

4. The invention set forth in claim 3 wherein said trigger means comprises a second rod and said securing means comprises a strap means surrounding said second and third bar means to confine said trigger means therebetween.

5. The invention set forth in claim 1, wherein said anchor further comprises means for locking said trigger means to said shaft.

6. The invention set forth in claim 5 wherein said locking means is slidably disposed on said shaft and movable between a first inoperative position and to a second locking position.

7. A boat anchor comprising:

a pair of generally planar, thin flukes having a point at one end and a straight side remote therefrom;

a hollow, generally cylindrical tube, said straight sides of said flukes being secured thereto whereby said flukes are generally coplanar and spaced apart from one another;

an anchor shaft rotatably coupled to said tube intermediate said flukes whereby said flukes may rotate freely for 360° about the axis of said tube;

elongate rod means loosely disposed within said tube and an opening in said tube intermediate said flukes;

second elongate rod means secured perpendicularly to said first elongate rod means and passing through said opening, said opening permitting a limited freedom of movement of said second rod means with respect to said tube; and breakable strap means for surrounding said second elongate rod means and said shaft whereby said flukes are free to move within an acute angle around the axis of said tube.

8. The invention set forth in claim 7 wherein said anchor further includes a locking means slidably disposed on said shaft for selectively surrounding said second elongate rod means and said shaft to prevent rotation of said flukes by more than said acute angle.

* * * * *